US007911309B2

(12) United States Patent
Tsai et al.

(10) Patent No.: US 7,911,309 B2
(45) Date of Patent: Mar. 22, 2011

(54) CONDUCTIVE WINDING MODULE AND TRANSFORMER HAVING SUCH CONDUCTIVE WINDING MODULE

(75) Inventors: Sheng-Nan Tsai, Taoyuan (TW); Tian-Chang Lin, Taoyuan (TW); Tsung-Sheng Yeh, Taoyuan (TW); Chung-Huan Chiu, Taoyuan (TW); Hsin-Wei Tsai, Taoyuan (TW); Ching-Hsien Teng, Taoyuan (TW)

(73) Assignee: Delta Electronics, Inc., Taoyuan Hsien (TW)

( * ) Notice: Subject to any disclaimer, the term of this patent is extended or adjusted under 35 U.S.C. 154(b) by 539 days.

(21) Appl. No.: 11/950,583

(22) Filed: Dec. 5, 2007

(65) Prior Publication Data

US 2009/0045901 A1 Feb. 19, 2009

(30) Foreign Application Priority Data

Aug. 15, 2007 (TW) ..... 96130187 A

(51) Int. Cl.
*H01F 5/00* (2006.01)

(52) U.S. Cl. ..... 336/200

(58) Field of Classification Search ..... 336/65, 336/83, 200, 232, 225
See application file for complete search history.

(56) References Cited

U.S. PATENT DOCUMENTS

| | | | | |
|---|---|---|---|---|
| 5,134,770 | A * | 8/1992 | Yerman et al. | 29/606 |
| 6,222,437 | B1 * | 4/2001 | Soto et al. | 336/200 |
| 6,556,117 | B1 * | 4/2003 | Nakao et al. | 336/105 |
| 6,985,062 | B2 * | 1/2006 | Nakata et al. | 336/200 |
| 7,408,436 | B2 * | 8/2008 | Ikezawa | 336/208 |
| 7,511,599 | B2 * | 3/2009 | Ye et al. | 336/200 |

* cited by examiner

*Primary Examiner* — Tuyen Nguyen

(57) ABSTRACT

A conductive winding module includes a plurality of conductive parts and at least one connecting part. Each conductive part includes a conductive body, a first terminal and a second terminal. The conductive body is interconnected between the first terminal and the second terminal and having a hollow portion therein. The connecting part has a first end and a second end for interconnecting any two adjacent conductive parts. A first connecting line is defined between the first end of the connecting part and the first terminal of an adjacent conductive part. A second connecting line is defined between the second end of the connecting part and the second terminal of an adjacent conductive part. The conductive parts are folded with respect to the first connecting line and the second connecting line such that the first hollow portions of the conductive parts are aligned with each other to define a through-hole.

18 Claims, 10 Drawing Sheets

CONDUCTIVE WINDING MODULE AND TRANSFORMER HAVING SUCH CONDUCTIVE WINDING MODULE

FIELD OF THE INVENTION

The present invention relates to a conductive winding module, and more particularly to a conductive winding module by continuously winding multiple loops of coils. The present invention also relates to a transformer having such a conductive winding module.

BACKGROUND OF THE INVENTION

A transformer has become an essential electronic component for voltage regulation into required voltages for various kinds of electric appliances. Referring to FIG. 1, a schematic exploded view of a conventional transformer disclosed in for example U.S. Pat. No. 7,091,817 is illustrated. The transformer 1 of FIG. 1 principally includes a winding frame member 10, a primary winding coil (not shown), multiple conductive pieces 12 and a magnetic core assembly 13. The winding frame member 10 includes a tube structure 101, a first partition plate 102 and a second partition plate 103. The first partition plate 102 is parallel with second partition plate 103. A winding section 104 is defined between the first partition plate 102, the second partition plate 103 and the external surface of the tube structure 101. In addition, bending pieces 105 and 106 are extended from both edges of the first partition plate 102 and the second partition plate 103, respectively. Accordingly, two guiding slots 107 are formed on opposite sides of the winding frame member 10 for accommodating corresponding conductive pieces 12 therein. The magnetic core assembly 13 includes a first magnetic part 131 and a second magnetic part 132. Each conductive piece 12 is a U-shaped copper piece and includes a hollow portion 121 facing the winding member 121. After the conductive pieces 12 are received in the guiding slots 107 and fixed onto the winding frame member 10, the conductive pieces 12 are electrically connected to a circuit board (not shown).

The conductive piece 12 of the transformer 1 is a one-loop structure. Although the one-loop conductive piece 12 may reduce the overall volume of the transformer 1, there are still some drawbacks. For example, the process of winding the coil is complicated because the conductive pieces 12 need to be accommodated within the guiding slots 107. In addition, the system board should have corresponding trace pattern for making electrical connection between these two conductive pieces 12. As a consequence, the power loss is increased and the components of the transformer are increased. Under this circumstance, the circuitry of the system board becomes more complicated.

In views of the above-described disadvantages resulted from the conventional method, the applicant keeps on carving unflaggingly to develop a conductive winding module and a transformer having such a conductive winding module.

SUMMARY OF THE INVENTION

It is an object of the present invention to provide a conductive winding module by continuously winding multiple loops of coils.

Another object of the present invention provides a conductive winding module for increasing the power density without considerably increasing the overall volume.

A further object of the present invention provides a transformer having such a conductive winding module, in which the transformer is suitable for mass production.

In accordance with an aspect of the present invention, there is provided a conductive winding module for use in a magnetic element. The conductive winding module includes a plurality of conductive parts and at least one connecting part. Each of the conductive parts includes a conductive body, a first terminal and a second terminal. The conductive body is interconnected between the first terminal and the second terminal and having a hollow portion therein. The connecting part has a first end and a second end for interconnecting any two adjacent conductive parts. A first connecting line is defined between the first end of the connecting part and the first terminal of an adjacent conductive part. A second connecting line is defined between the second end of the connecting part and the second terminal of an adjacent conductive part. The conductive parts are folded with respect to the first connecting line and the second connecting line such that the first hollow portions of the conductive parts are aligned with each other to define a through-hole.

In accordance with another aspect of the present invention, there is provided a transformer. The transformer includes a winding coil, a conductive winding module and a magnetic core assembly. The conductive winding module includes a plurality of conductive parts and at least one connecting part. Each of the conductive parts includes a conductive body, a first terminal and a second terminal. The conductive body is interconnected between the first terminal and the second terminal and having a hollow portion therein. The connecting part has a first end and a second end for interconnecting any two adjacent conductive parts. A first connecting line is defined between the first end of the connecting part and the first terminal of an adjacent conductive part. A second connecting line is defined between the second end of the connecting part and the second terminal of an adjacent conductive part. The conductive parts are folded with respect to the first connecting line and the second connecting line such that the first hollow portions of the conductive parts are aligned with each other to define a through-hole. The magnetic core assembly is partially embedded into the winding coil and the through-hole of the conductive winding module.

In accordance with a further aspect of the present invention, there is provided a transformer. The transformer includes a circuit board, a conductive winding module and a magnetic core assembly. The circuit board has a trace pattern of a primary winding coil and a first through-hole. The conductive winding module includes a plurality of conductive parts and at least one connecting part. Each of the conductive parts includes a conductive body, a first terminal and a second terminal. The conductive body is interconnected between the first terminal and the second terminal and having a hollow portion therein. The connecting part has a first end and a second end for interconnecting any two adjacent conductive parts. A first connecting line is defined between the first end of the connecting part and the first terminal of an adjacent conductive part. A second connecting line is defined between the second end of the connecting part and the second terminal of an adjacent conductive part. The conductive parts are folded with respect to the first connecting line and the second connecting line such that the first hollow portions of the conductive parts are aligned with each other to define a second through-hole. The magnetic core assembly is partially embedded into the first through-hole of the circuit board and the second through-hole of the conductive winding module.

The above contents of the present invention will become more readily apparent to those ordinarily skilled in the art after reviewing the following detailed description and accompanying drawings, in which:

BRIEF DESCRIPTION OF THE DRAWINGS

FIG. 2(*b*) is a schematic perspective view of the folded conductive winding module of FIG. 2(*a*);

FIG. 3(*b*) is a schematic perspective view of the folded conductive winding module of FIG. 3(*a*);

FIG. 4(*b*) is a schematic perspective view of the folded conductive winding module of FIG. 4(*a*);

DETAILED DESCRIPTION OF THE PREFERRED EMBODIMENT

The present invention will now be described more specifically with reference to the following embodiments. It is to be noted that the following descriptions of preferred embodiments of this invention are presented herein for purpose of illustration and description only. It is not intended to be exhaustive or to be limited to the precise form disclosed.

Figure 1:
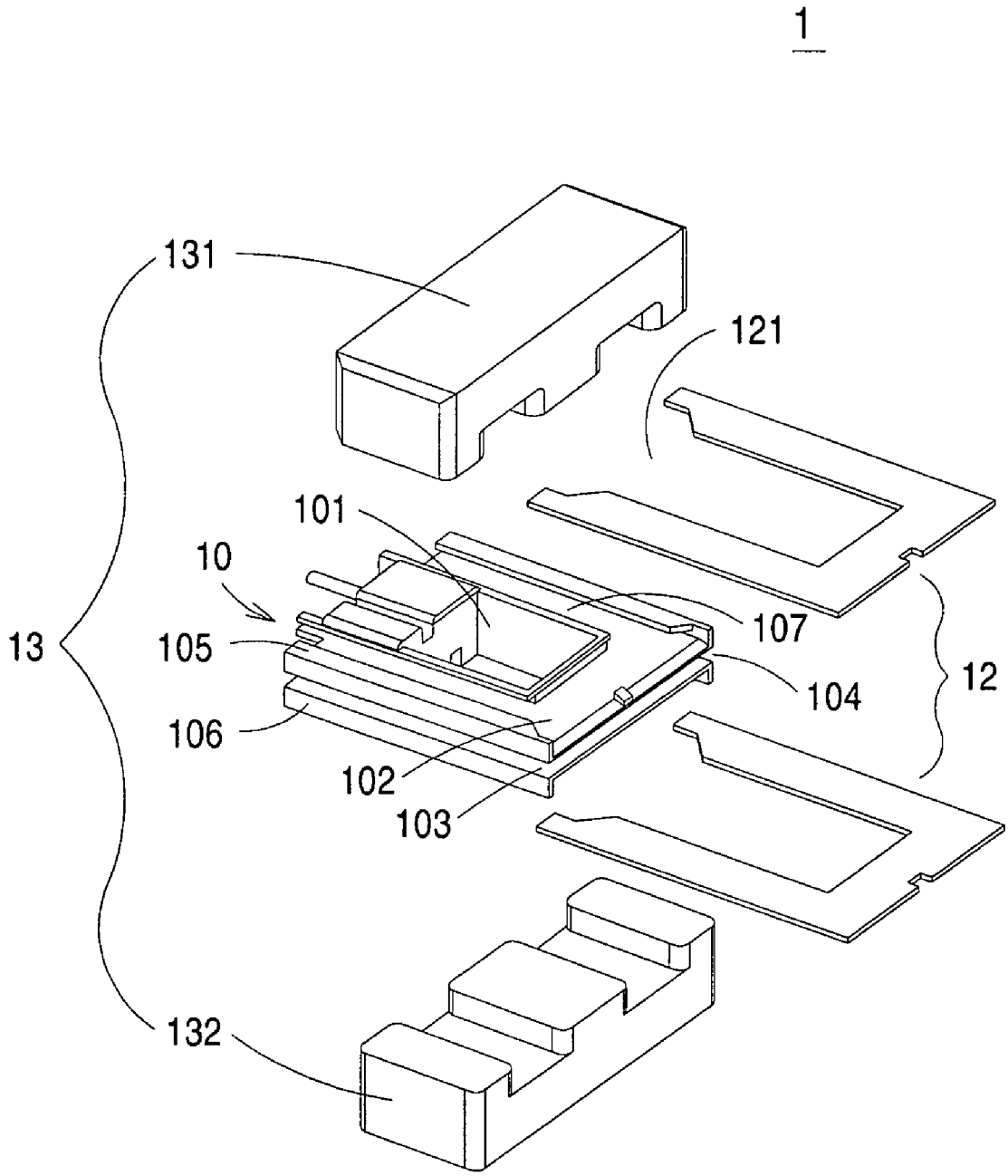
Fig.1 Prior Art
FIG. 1 is a schematic exploded view of a conventional transformer.
Figure 2A:
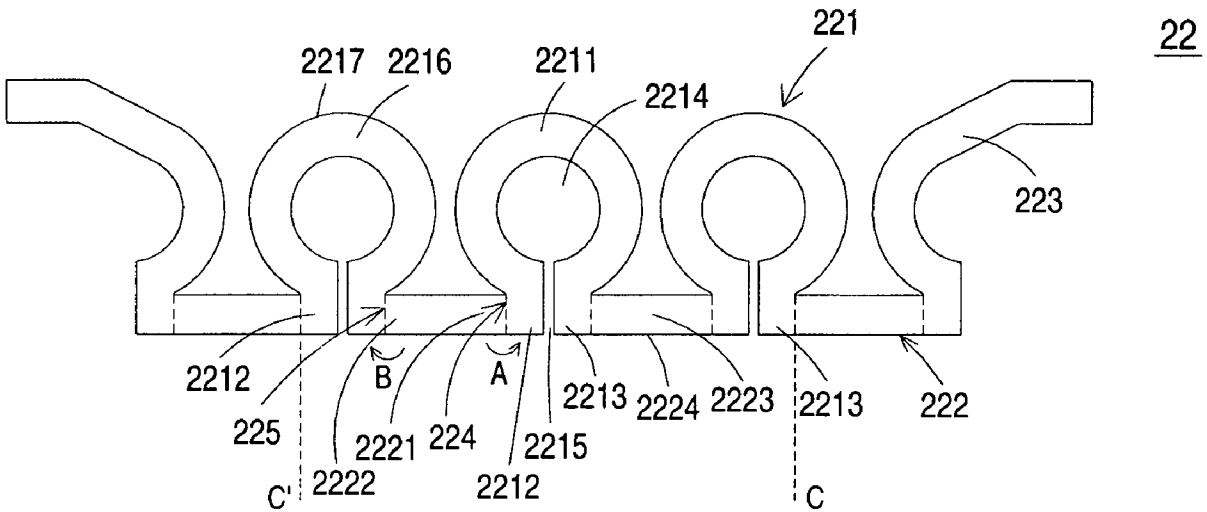
FIG. 2(*a*) is a schematic view illustrating a conductive winding module according to a first preferred embodiment of the present invention.
Figure 2B:
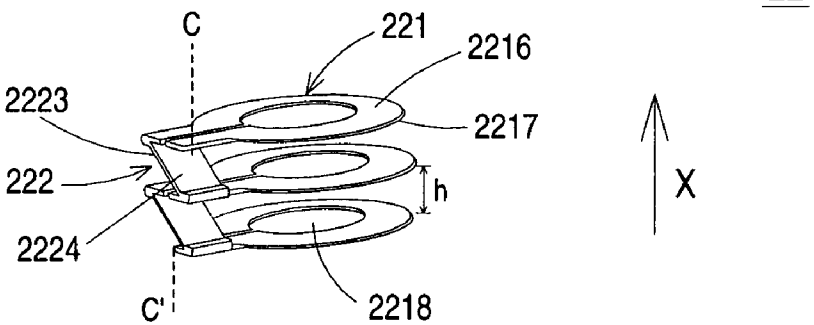

FIG. 2(*a*) is a schematic view illustrating a conductive winding module according to a first preferred embodiment of the present invention. The conductive winding module 22 is a single conductive piece made of metallic material such as copper. The conductive winding module 22 principally includes a plurality of conductive parts 221, a plurality of connecting parts 222 and pins 223. In this embodiment, three conductive parts 221 are included in the conductive winding module 22 for illustration. Every two adjacent conductive parts 221 are interconnected by a connecting part 222. Similarly, each pin 223 is coupled to the adjacent conductive part 221 through a connecting part 222.

Every conductive part 221 principally includes a conductive body 2211, a first terminal 2212, a second terminal 2213, a first surface 2216 and a second surface 2217. In this embodiment, the conductive body 2211 is ring-shaped and has a notch 2215 between the first terminal 2212 and the second terminal 2213. In addition, a hollow portion 2214 is formed in the center of the conductive body 2211. The second surface 2217 is opposed to the first surface 2216 for each conductive part 221. For example, the first surfaces 2216 of these conductive parts 221 face upwardly but the second surfaces 2217 thereof face downwardly.

Every connecting part 222 has a first end 2221 and a second end 2222. A first connecting line 224 is defined between the first end 2221 of the connecting part 222 and the first terminal 2212 of the adjacent conductive part 221. A second connecting line 225 is defined between the second end 2222 of the connecting part 222 and the second terminal 2213 of the adjacent conductive part 221. Likewise, the first side 2223 and the second side 2224 are respectively coplanar with the first surfaces 2216 and the second surfaces 2217 of the conductive parts 221.

By using the first connecting line 224 and the second connecting line 225 as bending lines, the first ends 2221 of the connecting parts 222 are bent in the direction A and the second ends 2222 of the connecting parts 222 are bent in the direction B. Then, these conductive parts 221 are folded with respect to the first connecting line 224 and the second connecting line 225 such that small acute angles are formed between the first side 2223 of a connecting part 222 and the first surface 2216 of an adjacent conductive part 221 and between the second side 2224 of a connecting part 222 and the second surface 2217 of an adjacent conductive part 221. The resulting structure of the folded conductive winding module is schematically shown in FIG. 2(*b*). Meanwhile, every two adjacent conductive parts 221 are parallel with each other. That is, the first surfaces 2216 of these conductive parts 221 face toward the same direction X. After the folding process, the hollow portions 2214 of these conductive parts 221 are aligned with each other to define a through-hole 2218. Due to the inherent rigidity and ductility of the conductive piece, there is a gap distance "h" between any two adjacent conductive parts 221.

Figure 3A:
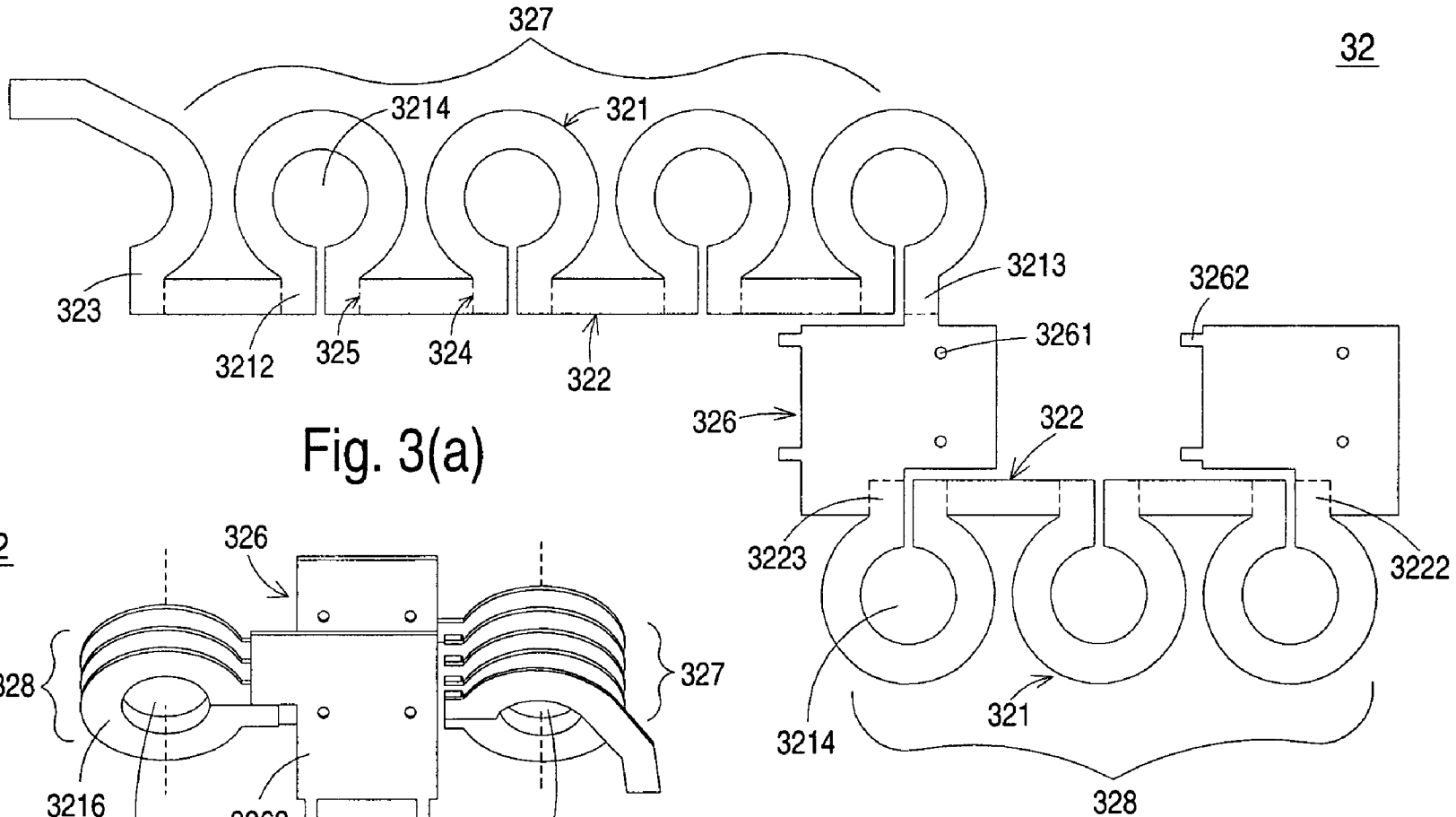
FIG. 3(*a*) is a schematic view illustrating a conductive winding module according to a second preferred embodiment of the present invention.
Figure 3B:
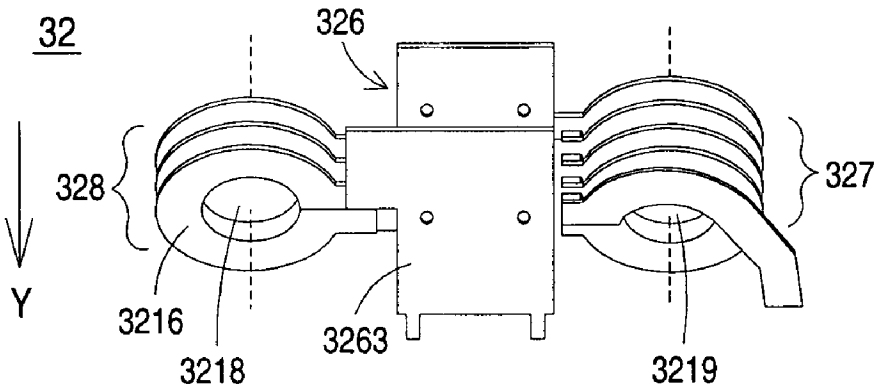

FIG. 3(*a*) is a schematic view illustrating a conductive winding module according to a second preferred embodiment of the present invention. The conductive winding module 32 is also a single conductive piece made of metallic material such as copper. The conductive winding module 32 principally includes a first winding unit 328 and at least an extension part 326. The first winding unit 328 may be used as the secondary winding coil of a transformer for example. The first winding unit 328 includes a plurality of conductive parts 321 and a plurality of connecting parts 322. Every two adjacent conductive parts 321 are interconnected by a connecting part 322. By using the similar folding process as described in FIGS. 2(*a*) and 2(*b*), the resulting structure of the folded first winding unit 328 is illustrated in FIG. 3(*b*).

In addition, two extension parts 326 are respectively coupled to a first side 3212 and a second side 3213 of the first winding unit 328. Each of the extension parts 326 has several holes 3261 and several pins 3262. In some embodiments, an electronic component such as a transistor may be fixed on the extension part 326 such that the extension part 326 functions as a heat sink. By penetrating for example screws (not shown) through the holes 3261 and then coupled with corresponding nuts (not shown), the electronic component may be fixed on the extension part 326. The pins 3262 may be bonded on a system board (not shown).

Please refer to FIG. 3(*a*) again. The conductive winding module 32 further includes a second winding unit 327. A terminal 3213 of the second winding unit 327 is coupled to one of the extension parts 326 and used as a winding coil of an inductor for example. The second winding unit 327 principally includes a plurality of conductive parts 321, a plurality of connecting parts 322 and a pin 323. Every two adjacent conductive parts 321 are interconnected by a connecting part 322. By using the similar folding process as described in FIGS. 2(*a*) and 2(*b*), the resulting structure of the folded second winding unit 327 is illustrated in FIG. 3(*b*). Similarly, the pins 323 may be bonded on a system board (not shown).

FIG. 3(*b*) is a schematic perspective view illustrating arrangement of the conductive winding module of FIG. 3(*a*) after the folding process. Please refer to FIGS. 3(*a*) and 3(*b*). The first surfaces 3216 of the conductive parts 321 and the first surfaces 3263 of the extension parts 326 face toward the same direction Y. In addition, the hollow portions 3214 of these conductive parts 321 are aligned with each other to define a first through-hole 3218. Likewise, the hollow portions 3214 of the conductive parts 321 of the second winding unit 327 are aligned with each other to define a second through-hole 3219.

It is noted that, however, those skilled in the art will readily observe that numerous modifications and alterations may be made while retaining the teachings of the invention. For example, the conductive winding module of the present invention may be an unbroken conductive piece having more than three loops. In addition, the conductive body of the conductive part of the conductive winding module may have an arbitrary shape such as a rectangular shape or a polygonal shape.

Figure 4A:
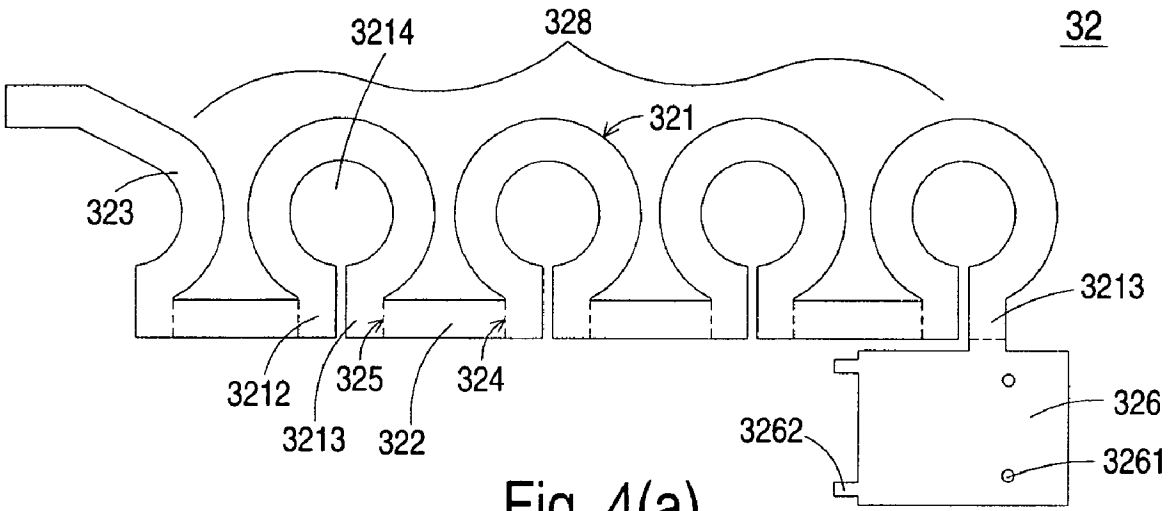
FIG. 4(*a*) is a schematic view illustrating a conductive winding module according to a third preferred embodiment of the present invention.
Figure 4B:
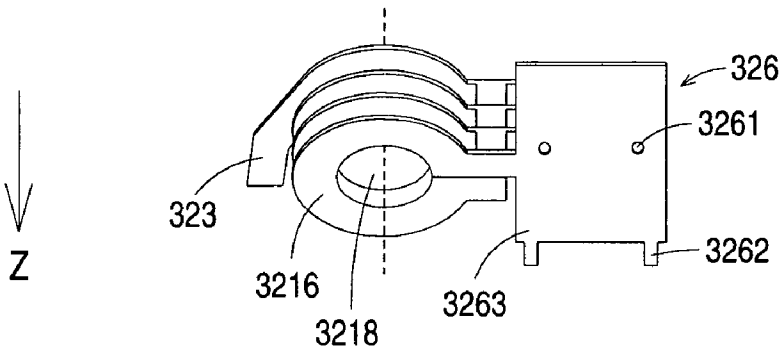

FIG. 4(*a*) is a schematic view illustrating a conductive winding module according to a second preferred embodiment of the present invention. The conductive winding module 32 is also a single conductive piece made of metallic material such as copper. The conductive winding module 32 principally includes a first winding unit 328, an extension part 326 and a pin 323. The first winding unit 328 may be used as the secondary winding coil of a transformer for example. The first winding unit 328 includes a plurality of conductive parts 321 and a plurality of connecting parts 322. Every two adjacent conductive parts 321 are interconnected by a connecting part 322. By using the similar folding process as described in FIGS. 2(*a*) and 2(*b*), the resulting structure of the folded first winding unit 328 is illustrated in FIG. 4(*b*).

In addition, a first side 3212 and a second side 3213 of the first winding unit 328 is coupled to the pin 323 and the extension parts 326, respectively. In some embodiments, an electronic component such as a transistor may be fixed on the extension part 326 such that the extension part 326 functions as a heat sink. By penetrating for example screws (not shown) through the holes 3261 and then coupled with corresponding nuts (not shown), the electronic component may be fixed on the extension part 326. The pins 3262 may be bonded on a system board (not shown).

FIG. 4(*b*) is a schematic perspective view illustrating arrangement of the conductive winding module of FIG. 4(*a*) after the folding process. Please refer to FIGS. 4(*a*) and 4(*b*). The first surfaces 3216 of the conductive parts 321 and the first surfaces 3263 of the extension parts 326 face toward the same direction Z. In addition, the hollow portions 3214 of these conductive parts 321 are aligned with each other to define a first through-hole 3218.

Figure 5:
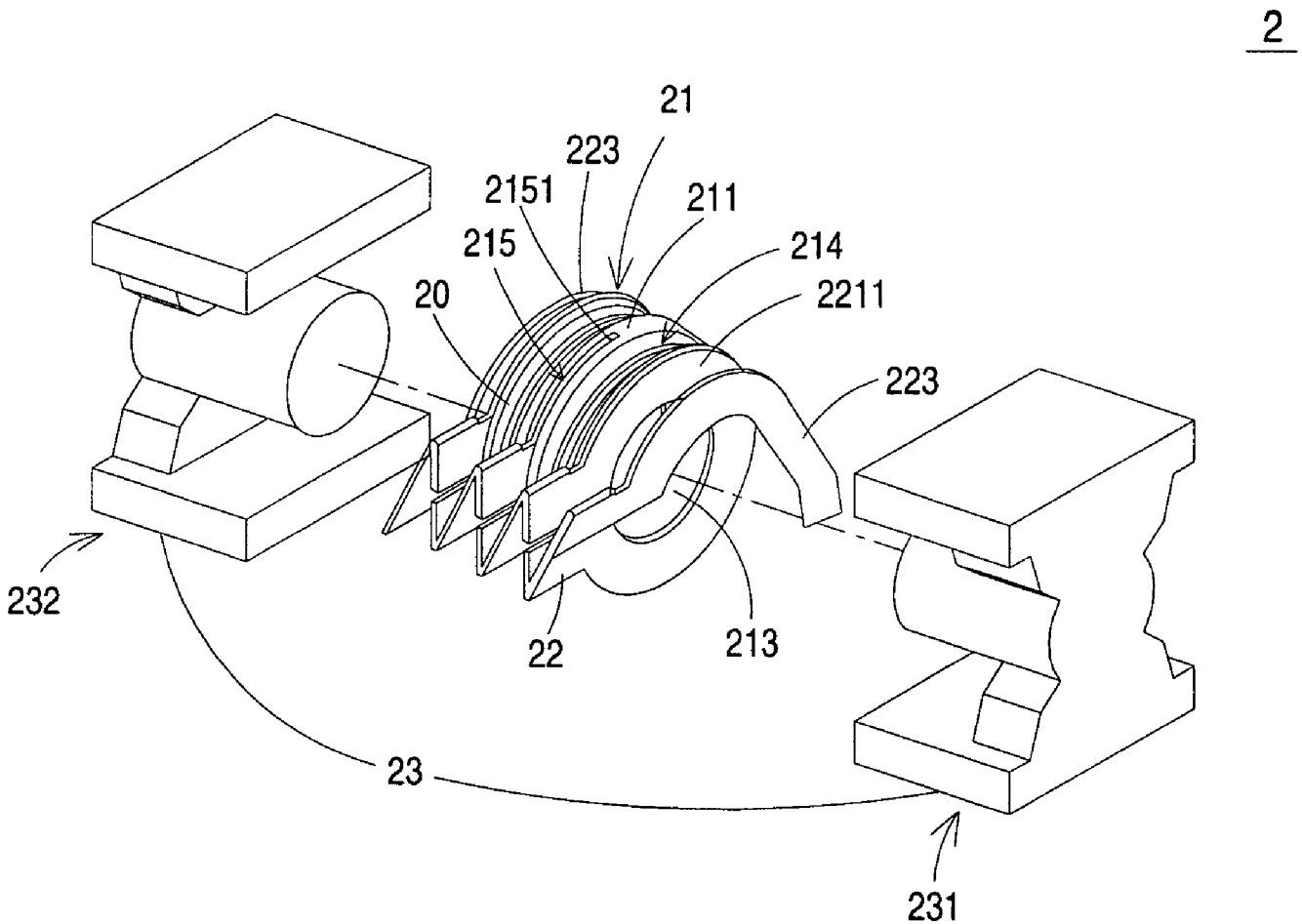
FIG. 5 is a schematic exploded view illustrating a transformer having a conductive winding module of FIG. 2.
Figure 6:
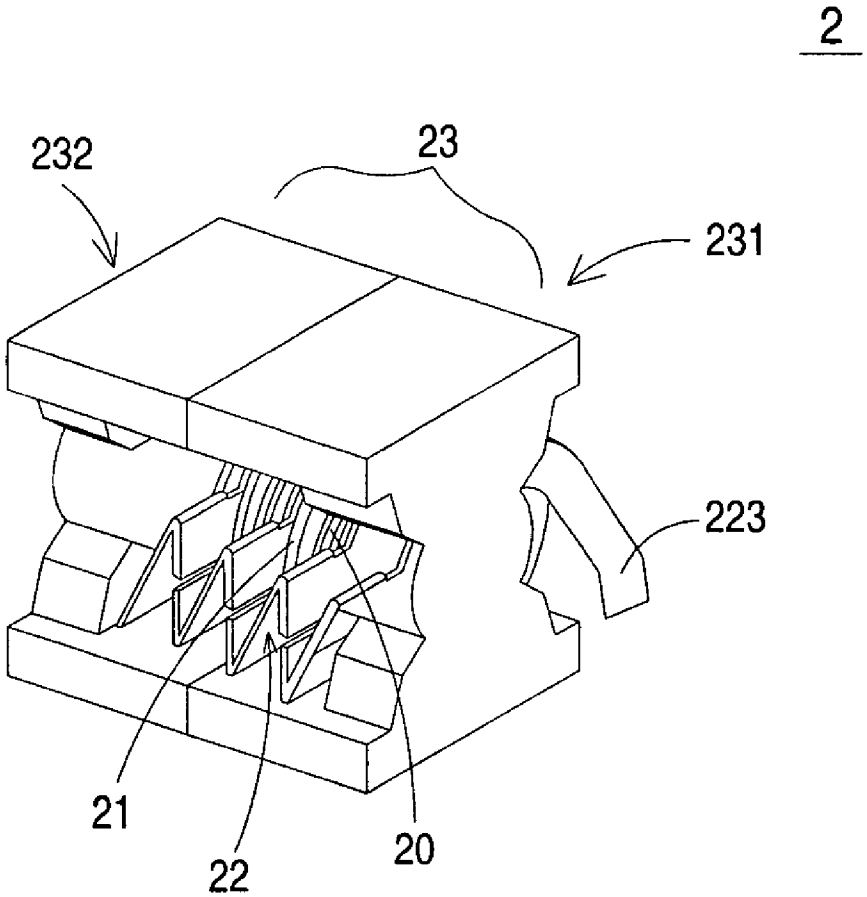
FIG. 6 is a schematic assembled view of the transformer of FIG. 5.

FIG. 5 is a schematic exploded view illustrating a transformer having a conductive winding module of FIG. 2. FIG. 6 is a schematic assembled view of the transformer of FIG. 5. As shown in FIGS. 5 and 6, the transformer 2 principally includes a winding coil 20, a bobbin 21, a conductive winding module 22 and a magnetic core assembly 23. In an embodiment, the winding coil 20 is a primary winding coil and the conductive winding module 22 is used as a secondary winding coil. The bobbin 21 includes a main body 211, a first channel 213, one or more winding sections 214 and one or more receiving portions 215. The first channel 213 is communicated with the receiving portions 215. The magnetic core assembly 23 includes a first magnetic part 231 and a second magnetic part 232. In this embodiment, the first magnetic part 231 and the second magnetic part 232 of the magnetic core assembly 23 are cooperatively formed as an EE-type core assembly. The middle portions of the first magnetic part 231 and the second magnetic part 232 are partially embedded into the first channel 213 of the bobbin 21 and communicated with the receiving portions 215. Each receiving portion 215 has an entrance 2151. The cross-sectional length of the entrance 2151 is substantially greater than the diameter of the corresponding conductive part 221 of the conductive winding module 22 such that the conductive part 221 may be inserted into the receiving portion 215 through the entrance 2151. In this embodiment, the conductive parts 221 at the bilateral sides of the conductive winding module 22 may be directly attached on bilateral sides of the bobbin 21 without embedding into the receiving portion 215. Moreover, the gap distance "h" between any two adjacent conductive parts 221 is greater than or equal to the width of each winding section 214. The primary winding coil 20 is wound on the winding sections 214. The diameter of the hollow portion 2214 of the conductive part 221 is substantially identical to that of the first channel 213 of the bobbin 21. After the conductive parts 221 are inserted into the corresponding receiving portions 215 through the entrances 2151, the hollow portion 2214 is communicated with the first channel 213. After the middle portions of the first magnetic part 231 and the second magnetic part 232 are embedded into the first channel 213 of the bobbin 21 and the hollow portions 2214, the transformer 2 is assembled. As a result, the primary winding coil 20 and the secondary winding coil (i.e. the conductive winding module 22) interact with the magnetic core assembly 23 to achieve the purpose of voltage regulation. In addition, by soldering the pins 223 on a system board (not shown), the transformer 2 is mounted on the system board.

In the above embodiments, the conductive winding module of the present invention may be applied to a magnetic element such as a transformer. Since the conductive winding module is an unbroken multi-loop conductive piece, the overall volume of the conductive winding module is reduced. As the loop number of the conductive winding module is increased, the power density is increased.

Figure 7:
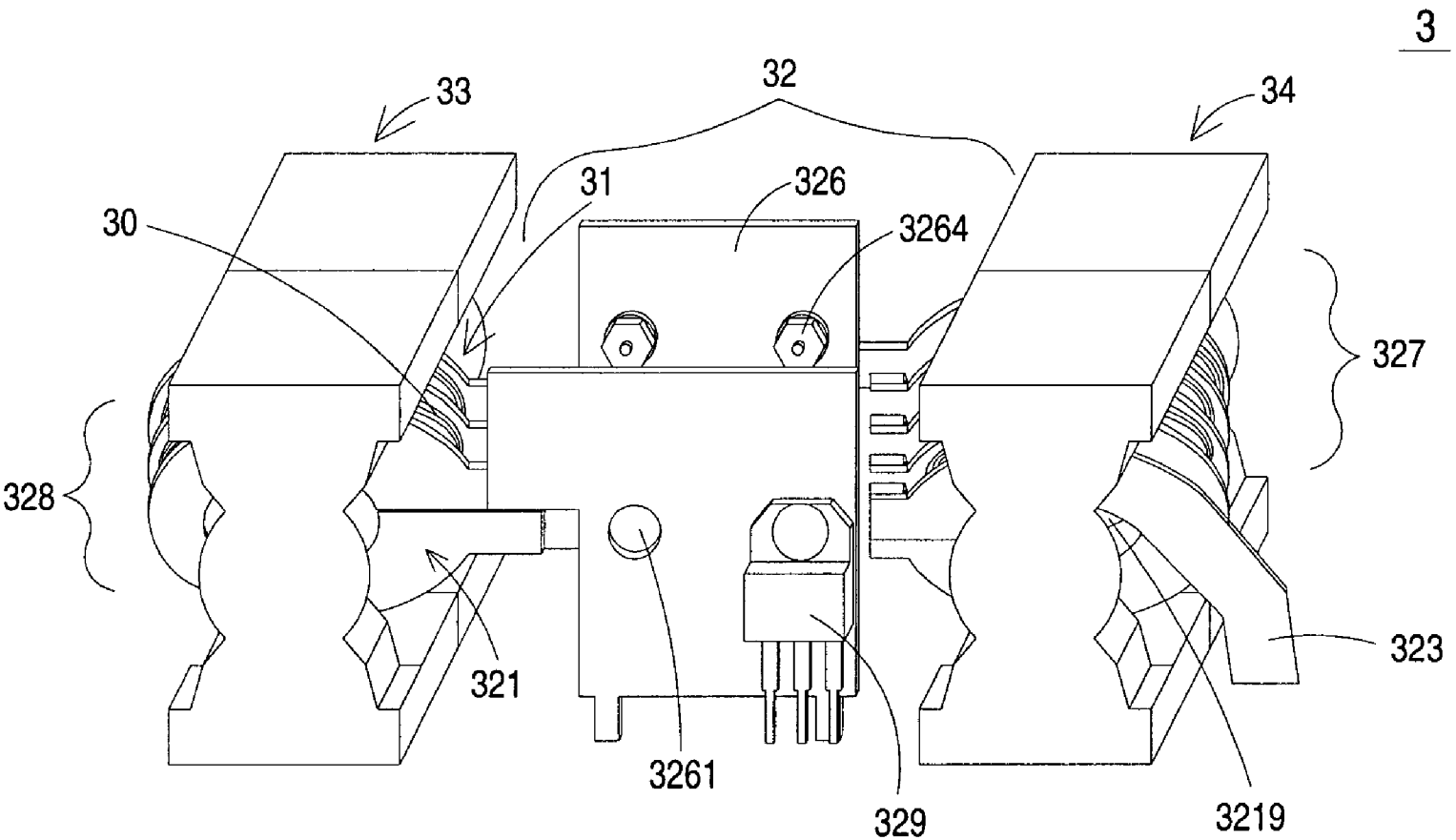
FIG. 7 is a schematic assembled view illustrating a transformer having a conductive winding module of FIG. 3(*b*)

FIG. 7 is a schematic assembled view illustrating a transformer having a conductive winding module of FIG. 3(*b*). As shown in FIG. 7, the transformer 3 principally includes a winding coil 30, a bobbin 31, a conductive winding module 32, a first magnetic core assembly 33 and a second magnetic core assembly 34. In an embodiment, the winding coil 30 is a primary winding coil and the first winding unit 328 of the conductive winding module 32 is used as a secondary winding coil. In addition, the second winding unit 327 is used as an inductor. The procedures of assembling the first winding unit 328 of the conductive winding module 32, the primary winding coil 30 and the first magnetic core assembly 33 are similar to those described in FIGS. 5 and 6, and are not redundantly described herein.

Please refer to FIG. 7 again. Two extension part 326 are opposed to each other. Two electronic components 329 such as transistors are fixed on the extension parts 326 by fasting fastening elements 3264 (e.g. screw/nut assemblies) in the holes 3261. Generally, the extension parts 326 of the conductive winding module 32 may facilitate dissipating heat of the electronic components 329 and increasing space utilization. In addition, the pins 3262 of the extension parts 326 may be bonded on a system board (not shown).

Figure 8:
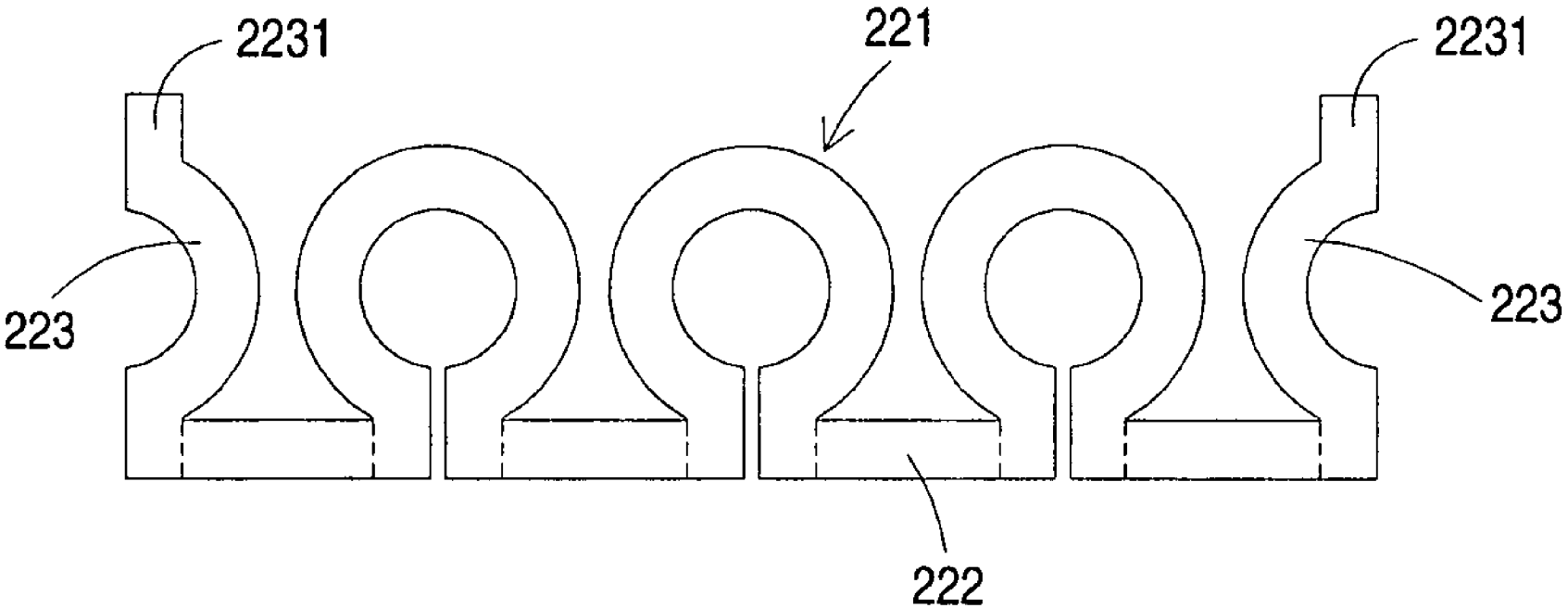
FIG. 8 is a schematic view illustrating a variant of the conductive winding module in FIG. 2(*a*)

FIG. 8 is a schematic view illustrating a variant of the conductive winding module in FIG. 2(*a*). The structures, the connecting means and the folding means of the conductive parts 221 and the connecting parts 222 are identical to those described in FIG. 2(*a*), and are not redundantly described herein. In this embodiment, the tip portions 2231 of the pins 223 are substantially perpendicular to the connecting parts 222.

Figure 9:
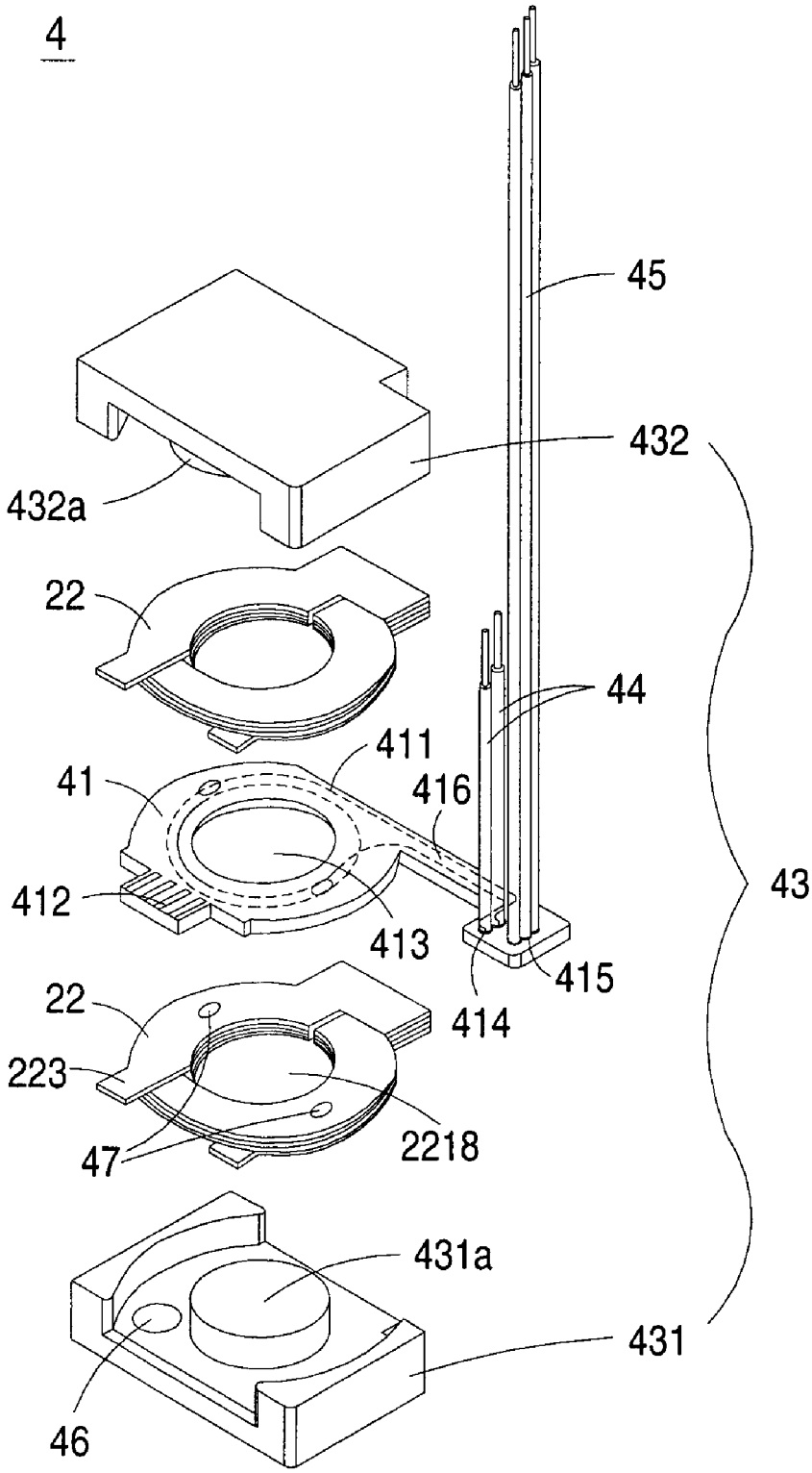
FIG. 9 is a schematic exploded view illustrating a transformer having a conductive winding module of FIG. 8.
Figure 10:
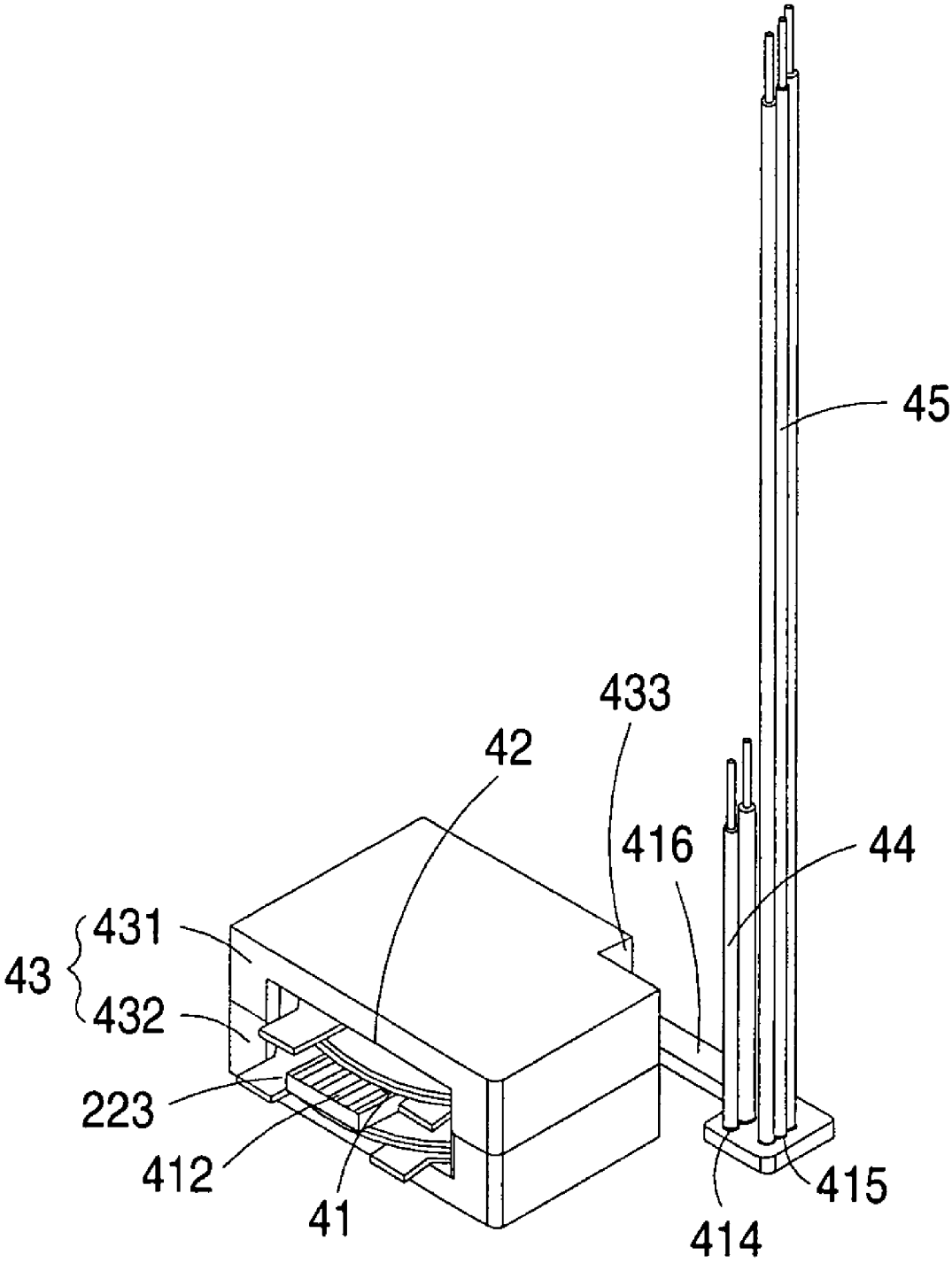
FIG. 10 is a schematic assembled view of the transformer of FIG. 9.

FIG. 9 is a schematic exploded view illustrating a transformer having a conductive winding module of FIG. 8. FIG. 10 is a schematic assembled view of the transformer of FIG. 9. As shown in FIGS. 9 and 10, the transformer 4 principally includes a circuit board 41, at least one conductive winding module 22 and a magnetic core assembly 43. The circuit board 41 is mainly a ring-shaped structure having a through-hole 413 in the center thereof. In addition, the circuit board 41 has a protrusion 416 extended from a side thereof. A primary winding coil 411 is formed as a trace pattern within the circuit board 41, and both terminals of the primary winding coil 411 are connected to power contacts 414. The power contacts 414 are further electrically connected to a power source (not shown) through wires 44 so as to transmit the input power to the circuit board 41. Moreover, the circuit board 41 has a signal connecting interface 412 (e.g. an edge connector). The signal connecting interface 412 is electrically connected to signal contacts 415 through specified trace pattern (not shown). The signal connecting interface 412 may be inserted into a corresponding slot of a system board (not shown) so that the control signals may be transmitted to the control circuit of the system board through the signal wires 45, the signal contacts 415 and the signal connecting interface 412. It is preferred that the power contacts 414 and the signal contacts 415 are arranged on the protrusion 416 of the circuit board 41 in order to provide a desired electrical safety distance.

Please refer to FIGS. 9 and 10 again. After the folding process, the hollow portions 2214 of these conductive parts 221 are aligned with each other to define a through-hole 2218. For assembling the transformer 4, the conductive winding module 22 is placed on the circuit board 21 such that the through-hole 413 of the circuit board 41 is aligned with the through-hole 2218 and the pins 223 of the conductive winding module 22 are extended in the same direction as the signal connecting interface 412. The magnetic core assembly 43 includes a first magnetic part 431 and a second magnetic part 432. The first magnetic part 431 and the second magnetic part 432 of the magnetic core assembly 43 are cooperatively formed as an EE-type core assembly. The middle portions 431*a* and 432*a* of the first magnetic part 431 and the second magnetic part 432 are partially embedded into the through-hole 2218 of the conductive winding module 22 and the through-hole 413 of the circuit board 41. As a result, the primary winding coil 411 of the circuit board 41 and the secondary winding coil (i.e. the conductive winding module 22) interact with the magnetic core assembly 43 to achieve the purpose of voltage regulation. In some embodiments, the magnetic core assembly 43 has an aperture 433 for the protrusion 416 of the circuit board 41 to penetrate therethrough, thereby providing a desired electrical safety distance.

For facilitating securely assembling the transformer 4, the inner surfaces of the first magnetic part 431 and the second magnetic part 432 are bonded onto the conductive winding module 22 via adhesives 46. Similarly, the conductive winding modules 22 are bonded onto the circuit board 41 via adhesives 47.

From the above description, the conductive winding module of the present invention may be used as the secondary winding coil of the transformer. Since the conductive winding module is an unbroken multi-loop conductive piece, the overall volume of the conductive winding module is reduced and the power loss is decreased. Since the process of assembling the conductive winding module is very simple, the transformer is suitable for mass production. Moreover, the extension parts of the conductive winding module may facilitate dissipating heat of electronic components and increasing space utilization.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A conductive winding module for use in a magnetic element, said conductive winding module comprising:

a plurality of conductive parts, each of which including a conductive body, a first terminal and a second terminal, said conductive body being interconnected between said first terminal and said second terminal and having a hollow portion therein;

at least an extension part, which is coupled to one of said conductive parts, wherein an electronic component is attached on said extension part for facilitating heat dissipation; and at least one connecting part having a first end and a second end for interconnecting any two adjacent conductive parts, wherein a first connecting line is defined between said first end of said connecting part and said first terminal of an adjacent conductive part, a second connecting line is defined between said second end of said connecting part and said second terminal of an adjacent conductive part, and said conductive parts are folded with respect to said first connecting line and said second connecting line such that said first hollow portions of said conductive parts are aligned with each other to define a through-hole.

2. The conductive winding module according to claim 1 wherein said magnetic element is a transformer.

3. The conductive winding module according to claim 1 wherein the conductive winding module is an unbroken multi-loop conductive piece made of metallic material.

4. The conductive winding module according to claim 3 wherein said metallic material is copper.

5. The conductive winding module according to claim 1 wherein said conductive body has a ring-shaped, rectangle-shape or a polygon-shaped profile with a notch.

6. The conductive winding module according to claim 1 wherein each of said conductive parts has a first surface and a second surface, and said first surfaces and second surfaces of said conductive parts are arranged in opposite directions.

7. The conductive winding module according to claim 1 further including at least a pin, which is coupled to one of said conductive parts.

8. The conductive winding module according to claim 1 wherein said extension part includes at least a pin.

9. The conductive winding module according to claim 1 wherein said conductive parts and said connecting parts are cooperatively formed as a first winding unit and a first side of said extension part is coupled to said first winding unit.

10. The conductive winding module according to claim 9 further including a second winding unit having a plurality of conductive parts and at least a connecting part, wherein a second side of said extension part is coupled to said second winding unit.

11. The conductive winding module according to claim 10 wherein said first winding unit is a primary winding coil of a transformer and said second winding unit is a winding coil of an inductor.

12. A transformer comprising:

a winding coil;

a conductive winding module including a plurality of conductive parts and at least one connecting part, each of said conductive parts including a conductive body, a first terminal and a second terminal, said conductive body being interconnected between said first terminal and said second terminal and having a hollow portion therein, said connecting part having a first end and a second end for interconnecting any two adjacent conductive parts, wherein a first connecting line is defined between said first end of said connecting part and said first terminal of an adjacent conductive part, a second connecting line is defined between said second end of said connecting part and said second terminal of an adjacent conductive part, and said conductive parts are folded with respect to said first connecting line and said second connecting line such that said first hollow portions of said conductive parts are aligned with each other to define a through-hole;

a bobbin including a main body and one or more receiving portions arranged on said main body for accommodating said conductive parts of said conductive winding module; and a magnetic core assembly partially embedded into said winding coil and said through-hole of said conductive winding module.

13. The transformer according to claim 12 wherein said bobbin includes:

one or more winding sections arranged on said main body for winding said winding coil thereon; and said main body having a channel therein.

14. The transformer according to claim 13 wherein said receiving portion has an entrance, and the cross-sectional length of said entrance is substantially greater than the diameter of said conductive body of said conductive part such that said conductive part is inserted into said receiving portion through said entrance.

15. The transformer according to claim 12 wherein the conductive winding module is an unbroken multi-loop conductive piece made of metallic material.

16. A transformer comprising:

a circuit board having a trace pattern of a primary winding coil, a plurality of power contacts electrically connected to said primary winding coil, a signal connecting interface to be mounted on a system board, a plurality of signal contacts electrically connected to said signal connecting interface and a first through-hole;

a conductive winding module including a plurality of conductive parts, at least an extension part and at least one connecting part, each of said conductive parts including a conductive body, a first terminal and a second terminal, said conductive body being interconnected between said first terminal and said second terminal and having a hollow portion therein, said extension part is coupled to one of said conductive parts, wherein an electronic component is attached on said extension part for facilitating heat dissipation, and said connecting part having a first end and a second end for interconnecting any two adjacent conductive parts, wherein a first connecting line is defined between said first end of said connecting part and said first terminal of an adjacent conductive part, a second connecting line is defined between said second end of said connecting part and said second terminal of an adjacent conductive part, and said conductive parts are folded with respect to said first connecting line and said second connecting line such that said first hollow portions of said conductive parts are aligned with each other to define a second through-hole; and a magnetic core assembly partially embedded into the first through-hole of the circuit board and the second through-hole of the conductive winding module.

17. The transformer according to claim 16 wherein said signal connecting interface is an edge connector.

18. The transformer according to claim 16 wherein said circuit board further includes a protrusion, and said power contacts and said signal contacts are arranged on a terminal of said protrusion.

* * * * *